United States Patent [19]

Harper, Jr.

[11] 4,283,156

[45] Aug. 11, 1981

[54] JOINT FOR SPACE FRAMES

[75] Inventor: George C. Harper, Jr., Coraopolis, Pa.

[73] Assignee: Pittsburgh-Des Moines Steel Company, Pittsburgh, Pa.

[21] Appl. No.: 138,526

[22] Filed: Apr. 8, 1980

[51] Int. Cl.[3] ..... F16B 1/00

[52] U.S. Cl. ..... 403/218; 403/172; 52/80

[58] Field of Search ..... 403/169, 170, 171, 172, 403/173, 174, 175, 176, 177, 178, 259, 219, 218, 217; 52/80, 81, 648

[56] References Cited

U.S. PATENT DOCUMENTS

| | | | |
|---|---|---|---|
| 3,323,820 | 6/1967 | Braccini | 52/81 X |
| 4,045,902 | 9/1977 | Ohmura | 403/373 X |

FOREIGN PATENT DOCUMENTS

| | | | |
|---|---|---|---|
| 2313518 | 12/1976 | France | 52/648 |
| 607909 | 5/1978 | U.S.S.R. | 403/219 |

*Primary Examiner*—Andrew V. Kundrat

*Attorney, Agent, or Firm*—Shoemaker and Mattare, Ltd.

[57] ABSTRACT

A joint for use with a space frame for connecting a plurality of struts together. The joint permits dome fabrication and erection with essentially no field bolting required. A central hub is included in the joint for resisting forces transmitted to the joint by dome struts.

5 Claims, 4 Drawing Figures

JOINT FOR SPACE FRAMES

BACKGROUND OF THE INVENTION

The present invention relates in general to roofs, and, more particularly, to space frames, such as geodesic or reticulated dome roofs.

Many tanks, such as storage tanks, or the like, use space frame structures. Such space frames include geodesic dome structures. The dome structures include a multiplicity of struts which are connected together. Heretofore, the interconnecting of the struts required a multiplicity of bolts and bolt-receiving holes. Loads on the frames include the dead weight of the structure, any wind pressure applied to the structure, and loads due to snow. The loads are transferred from the panels to the struts and from the struts through any means used to interconnect the struts.

The joint arrangements of the prior art structures involve substantial costs. In these prior art joint arrangements, many bolts and parts were used, and much bolting had to be done in the field. Such field assembly has many drawbacks. First, expenses involved in the field assembly far exceed expenses involved in shop assembly. Second, in a shop, jigs, fixtures, and the like can be employed in the assembly process, and assembly-line type procedures can be established. Such advantages are not practical in the field. Thus, as much assembly as possible should be carried out in a shop.

There is thus need for a structure which can be quickly and easily erected and which utilizes joints which can have a great deal of fabrication or assembly carried out in the shop.

The prior art structures have also suffered from a drawback arising because beam stresses and forces are not satisfactorily handled. With the prior art connections, the beams connected to a connector tend to move independently and may even cause distortion of some parts of the prior art joints.

There is thus a need for a dome joint structure which will distribute and resist stresses and forces better than the prior art structures.

It is also noted that domes may have a tendency to deform or buckle under loading. The loading can be caused by snow, or the like. There is thus a need for a structure which can be quickly and easily fabricated and assembled, with as much of the work as possible being carried out in the shop, and which can be used to resist dome buckling and/or deformation under loading.

A joint connector overcoming these problems is disclosed in a prior patent application, Ser. No. 971,033, filed on Dec. 19, 1978, by this inventor. However, this prior joint connector requires bolts, plates, and the like for assembly. Thus, while the just-mentioned joint connector represents a step forward in the art, that joint connector also has problems associated with bolts, multiple parts, and difficulty of assembly, although this last-mentioned difficulty is minimal with respect to the art prior to that invention.

Thus, there is need for a joint connector used in space frames which is easily and simply assembled in the field without bolts, welding, gaskets, or the like, and which has a minimum number of parts.

SUMMARY OF THE INVENTION

The frame assembly embodying the teachings of the present invention is easily and simply assembled and erected with a minimum of field assembly and no bolting, welding, gaskets, or the like being required. The connector includes only a minimum number of parts.

The system embodying the teachings of the present invention comprises a space frame which is fully clad. The surface of the disclosed space frame encloses a segment of one base of a sphere, and includes straight members as prismatic structural elements arranged in a pattern of divisions producing triangular elements of surface area. Light guage sheeting of metal, plastic, or other materials, is used for surface cladding. This joint would be suitable for a variety of space frame geometries and structural element sections.

A plurality of dome struts are connected to a single hub connector, and a plurality of hub connectors are included. The hub connectors provide a quick, easy connection during assembly operations of the struts to a hub point. The design is such that it: accommodates compressive stresses from the struts; transmits bending moments from the struts through the hub point; resists snap-through buckling; provides for a change in slope of the struts with respect to the hub point; provides for easy horizontal orientation of the strut with respect to the hub point; provides for attachment of a sealing cover over the hub point and for attachment of a temporary lifting device to facilitate erection.

The joint connector includes a tubular hub having a gripping jaw on one end thereof and a fastening means on the other end thereof. An annular clamping ring is connected to the hub by the fastening means and includes a depending flange which extends toward the gripping jaw when the ring is in place on the hub. The gripping jaw extends toward the ring.

A pair of grooves are machined in each strut to receive the gripping jaw and the clamping ring flanges, respectively, to thereby sandwich the strut between these two members. The strut is thus quickly and easily attached to the hub.

A cover can be included to protect the joint connector, and covers the clamping ring.

OBJECTS OF THE INVENTION

It is, therefore, a main object of the present invention to provide a joint for a space frame which is easily and quickly assembled and erected.

It is another object of the present invention to provide a joint for a space frame which can be assembled with a minimum of field assembly.

It is yet another object of the present invention to provide a joint for a space frame which is constructed with no bolting being required.

It is a further object of the present invention to provide a joint for a space frame which can be assembled without requiring welding.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
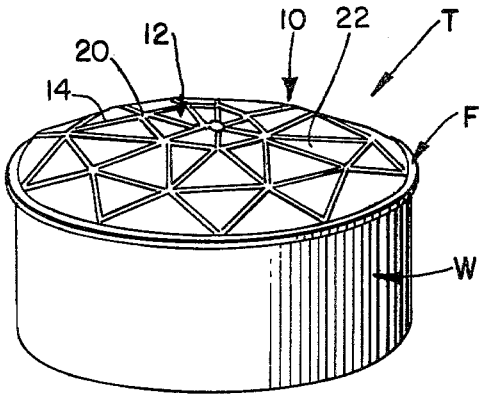
FIG. 1 is a perspective of a tank utilizing a space frame utlizing the joints embodying the teachings of the present invention.

Shown in FIG. 1 is a tank T having a wall structure W and a space frame 10 functioning as the roof of the tank. The frame 10 is a simple, lightweight, easily erected, self-supporting structure which can be installed over petroleum tanks, sewage treatment facilities, and the like, and can be a geodesic dome type roof.

The frame 10 is arcuate and is supported on the wall top rim. The dome includes a multiplicity of sections 12 each defined by beams or struts 14 which are connected together by joint connectors 20 and each of which includes a panel 22 of lightweight sheeting of metal, plastic, or the like, forming the surface cladding. A peripheral flange F can surround the roof.

Figure 3:
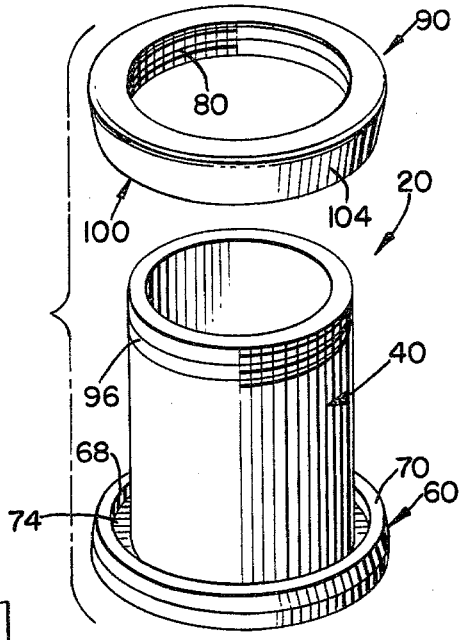
FIG. 3 is a perspective of a connector embodying the teachings of the present invention.
Figure 2:
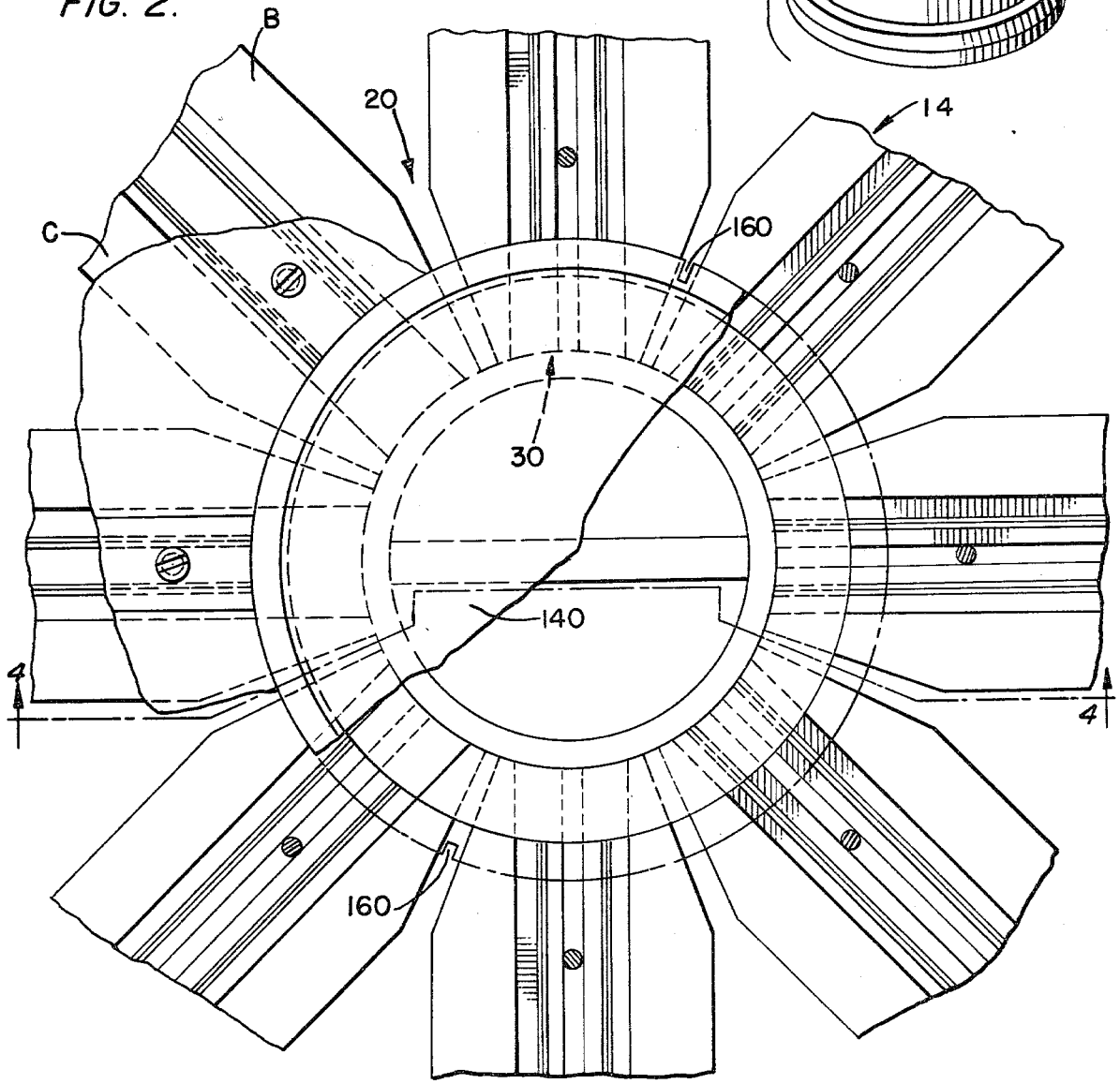
FIG. 2 is a partially cut away plan view of a space frame utilizing a joint embodying the teachings of the present invention.
Figure 4:
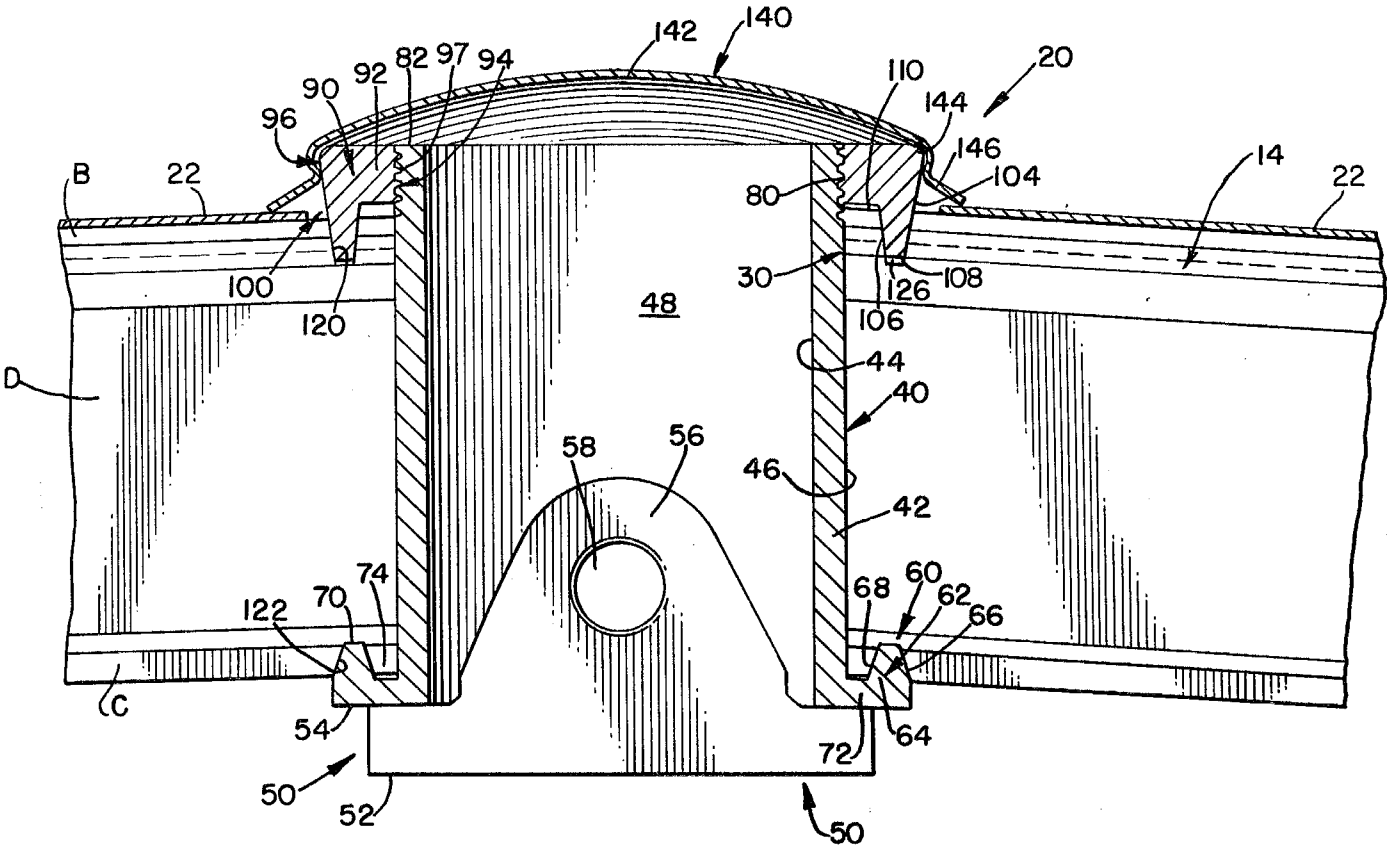
FIG. 4 is a view taken along line 4—4 of FIG. 2.

One of the joint connectors 20 is best shown in FIGS. 2–4, and attention is now directed to those figures. Each strut is in the form of an I-beam and includes top flanges B and C, a central longitudinal web D, and an end portion 30 which has been configured, by milling, machining, or the like, to be accommodated by an arcuate connector, as will be discussed below. The struts radiate outwardly from the connector, and, as the dome is arcuate, the struts will slope slightly downward from the connector (see FIG. 4); thus, the shape of the end portion 30 of the struts will enable each of the struts to be most effectively attached to appropriate joint connectors 20.

As best shown in FIGS. 3 and 4, the joint connector 20 includes a tubular hub 40 having a wall 42 which has an inner surface 44 and an outer surface 46 with a bore 48 being defined longitudinally of the hub. The hub is integral and unitary, and preferably is formed of cast aluminum, or the like.

A lifting stirrup 50 is associated with the joint connector for lifting during space frame erection procedures. The stirrup includes a base 52 spanning the diametric dimension of one end 54 of the hub, and an ear 56 integrally attached to the base 52. Lifting hole 58 is defined in the ear for attachment to an appropriate lifting device, such as a clevis, hook, or the like. Preferably, the stirrup is steel, or other such material.

The hub 40 is unitary and integral and includes a gripping jaw 60 circumferentially surrounding the wall 42. The gripping jaw includes a flange 62 which, as best shown in FIG. 4, is in the form of a truncated isosceles triangle in cross section. The triangle has a base 64, sides 66 and 68, and a planar top 70. The flange is located on a support ring 72 and is spaced radially outward from the wall 42 to define an annular gap 74.

Releasable fastening means, such as screw threads 80, is integrally associated with the hub 40 and is located at or near hub end 82 which is remote from the hub end 54. An annular clamping ring 90 is included with the joint connector 20, and has a base 92 with an inner periphery 94 and an outer periphery 96. The inner periphery defines a bore having a diameter corresponding to the outer diameter of the hub wall 42. Fastening means, such as screw threads 97, or the like, is defined on the inner periphery 94 to be complementary to the fastening means 80 defined on the hub for cooperation therewith.

The clamping ring includes a flange 100 depending from the base 92. The flange 100 is in the shape of a truncated triangle in cross section, as best shown in FIG. 4, and includes sides 104 and 106, and planar top 108. The flange 100 is spaced from the inner periphery 94 to define an annular gap 110 with the hub wall when the ring is attached to the hub. As shown in FIGS. 3 and 4, the flange 100 is radially inwardly declining from the outermost periphery of the clamping ring due to the slope of the triangle side 104. The clamping ring can be formed of aluminum, stainless steel, or other such material, and the screw threads 80 and 96 are fast threads, or the like.

As best shown in FIG. 4, each of the struts has arcuate grooves 120 and 122 defined in the top and bottom flanges, respectively. The grooves are spaced from the strut end 30 and extend into the strut flanges B and C. The grooves are shaped and positioned to receive the flanges 62 and 100 of the gripping jaw and the clamping ring, respectively, so that the strut is sandwiched between the gripping jaw 60 and the clamping ring 90 when the strut is attached to the joint connector 20. Thus, the grooves have inwardly converging sides which are sloped to match the slope of the above-discussed flange sides. However, as shown in FIG. 4, the groove 120 is deeper than the length of the flange 100, thereby defining a gap 126 which permits proper orientation of the strut with respect to the hub.

A snap-on cover 140 has a dish-shaped top 142 and an arcuate side 144 which has a radius of curvature different than that of top 142 and a peripheral skirt 146 integrally attached to the arcuate side 144 to be radially outward and sideways declining therefrom. The side 144 grips the outer periphery 96 of the clamping ring, and the skirt 146 forms flashing from the joint connector 20 to the roof panels 22. The cover is formed of spanned aluminum, galvanized steel, stainless steel, or the like. Caulking, or other sealant, can be used to further insure the integrity of the seal formed by the flashing to the roof panels.

As shown in FIGS. 2 and 3, notches 160 are defined in the clamping ring, preferably on diametrically opposite sides thereof. The notches accommodate a spanner wrench, or other such torquing device.

As is evident from the above discussion, the strut end 30 is machined to be arcuate and to slope so that the end 30 abuts the arcuate hub 40 and permits the slope of the strut shown in FIG. 4.

Assembly of the connector 20 to a strut is carried out without bolts or welding requirements and without gaskets. Ordinary tools can be used, and assembly is easily carried out in the field. A strut is edge abutted against hub wall 42, and set onto the gripping jaw 60 so that the flange 62 is received in the groove 122. The strut is maintained in position while the clamping ring 90 is placed in position. The flange 100 of the clamping ring is received in the groove 120 and the strut is securely attached to the hub 40. Stresses arising in the strut are distributed as afore-discussed, and the joint connector is thus easily and quickly assembled. The cover 140 can be easily snapped in place, and assembly is completed.

The various parts of the connector can be shop fabricated and field assembled. Attachment of the various parts of the joint assembly can be accomplished in the fabricating shop. Field assembly is as above-discussed.

The function of the hub can best be understood by referring to FIG. 4. At a connector there are a plurality of beams converging which are all connected to the joint connector. Other than the hub, there is no structure tying the top and bottom flanges of each strut together; thus, there is no element, other than the hub, to resist shear. Thus, for example, if forces urge one beam to move radially with respect to the joint, unresisted forces in the joint may occur. However, due to the presence of the hub, all of the beams, or struts, are tied together by that hub. Thus, if loading tends to urge one beam to move radially with respect to the hub, the forces tending to cause that radial movement are transferred through the hub. It is here noted that the terms "top" and "bottom" are used for illustrative purposes only and are not in any way intended to be limiting.

The hub also accommodates shear. By considering a single beam, it is seen that there is an axial load, a moment trying to bend the beam about the strong axis thereof, a moment trying to bend the beam about the weak axis thereof, and shear forces on the ends of the beam. Moments are transferred to the structure, and the shear is effectively resisted.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A joint connector for use in space frames to connect a plurality of struts together, comprising:

an integral, tubular hub having a wall, and first and second ends with a gripping jaw being located on said first end, and hub fastening means being located on said second end, said gripping jaw including a flange spaced from said hub wall and surrounding said hub wall;

a clamping ring having fastening means for cooperating with said hub fastening means to releasably secure said clamping ring to said tubular hub, said clamping ring including a flange which is spaced from said hub wall and extending toward said gripping jaw flange when said clamping ring is secured to said hub;

a lifting stirrup attached to said first end and including a base spanning said first end and an ear attached to said base and terminating in said hub, said ear having attaching means defined therein for attaching a lifting device to said stirrup; and said clamping ring and gripping jaw sandwiching a strut therebetween to attach such strut to said hub.

2. The joint connector defined in claim 1 further including a cover covering said clamping ring.

3. The joint connector defined in claim 1 wherein said fastening means include screw threads.

4. The joint connector defined in claim 1 wherein said flanges are triangular in cross-sectional shape.

5. The joint connector defined in claim 1 wherein the strut includes a plurality of grooves each positioned to accommodate one of said flanges.

* * * * *